US006250187B1

(12) United States Patent
Ju et al.

(10) Patent No.: US 6,250,187 B1
(45) Date of Patent: Jun. 26, 2001

(54) SCREWDRIVER WITH AN IMPACT DEVICE

(76) Inventors: De-Cheng Ju, No. 369, Shihu Road; Bing-Kwe Lim, 7Fl., No. 1059, Ren Yu Rd., both of Dali City, Taichung (TW)

( * ) Notice: Subject to any disclaimer, the term of this patent is extended or adjusted under 35 U.S.C. 154(b) by 0 days.

(21) Appl. No.: 09/474,243

(22) Filed: Dec. 29, 1999

(51) Int. Cl.[7] ..... B25B 19/00

(52) U.S. Cl. ..... 81/463; 81/465; 81/177.4; 81/177.6

(58) Field of Search ..... 81/463, 465, 177.4, 81/177.6

(56) References Cited

U.S. PATENT DOCUMENTS 3,435,862 * 4/1969 Rainey .
4,858,504 * 8/1989 Tsai .
5,012,709 * 5/1991 Su .
5,214,987 * 6/1993 Fenton, Sr. .

* cited by examiner

*Primary Examiner*—Timothy V. Eley
*Assistant Examiner*—William Berry, Jr.
(74) *Attorney, Agent, or Firm*—Rosenberg, Klein & Lee

(57) ABSTRACT

A screwdriver includes a handle in which a chamber and a recess are respectively defined in two ends of the handle. An annular flange with a passage extends radially inward from an inside of the handle. A block and a spring are received in the chamber, and an impact rod with a spring mounted thereto is received in the recess. A tube extends from the handle and a shank is movably received in the tube so that on end of the shank contacts the impact rod and the other end of the shank contacts a bit engaged with a distal end of the tube. The block is pushed to compress the spring when the bit is pushed onto an object. When the impact rod drop into the dent, the block hit the impact rod and the bit exerts a sudden and large force to the object.

3 Claims, 6 Drawing Sheets

SCREWDRIVER WITH AN IMPACT DEVICE

FIELD OF THE INVENTION

The present invention relates to a screwdriver, and more particularly, to a screwdriver having an impact device which provides a sudden and large impact to an object so as to loosen or tighten the object.

BACKGROUND OF THE INVENTION

A conventional screwdriver generally includes a handle and a shank which has a functional end. The functional end is used to engage with an object such as a bolt or nut, so that when rotating the screwdriver, the object can be loosened or tightened. However, sometimes the object is rusted and is securely attached to the parts that are adjacent to the object. In other words, the bolt and the parts adjacent to the bolt are a one-piece member, the rust grasps the bolt securely and the screwdriver cannot provide a large enough force to the bolt to let the bolt separate from the parts. The operator generally hits the rust or the bolt to vibrate and separate the rust from the bolt so as to easily rotate the bolt. Accordingly, the operator needs a hammer to hit the handle of the screwdriver to let the rust be broken.

The present invention intends to provide a screwdriver that has an impact device comprising a spring and an impact rod so that the user pushes the shank against the object and compresses the spring so as to let the impact rod impact the bit of the screwdriver to shake the rust and/or the bolt. The screwdriver of the present invention is easily used and provides an effective shaking feature to loosen a bolt or a nut that is secured to rust.

SUMMARY OF THE INVENTION

In accordance with one aspect of the present invention, there is provided a screwdriver comprising a handle having a chamber and a recess defined in two ends of the handle. An annular flange extends radially inward from an inside of the handle and is located between the recess and the chamber. A passage is defined through the annular flange and communicates with the recess and the chamber. A shank extends from an end of the handle. A block and a spring are respectively received in the chamber, and a cap seals the other end of the handle. An impact rod is movably received in the recess and a spring is mounted to the impact rod. A first end of the impact rod is sized to be inserted into the passage and a second end of the impact rod contacts the shank.

The object of the present invention is to provide a screwdriver that includes an impact device received therein so that the user may exert a sudden and large force to a rusted object to break the rust.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENTS

Figure 1:
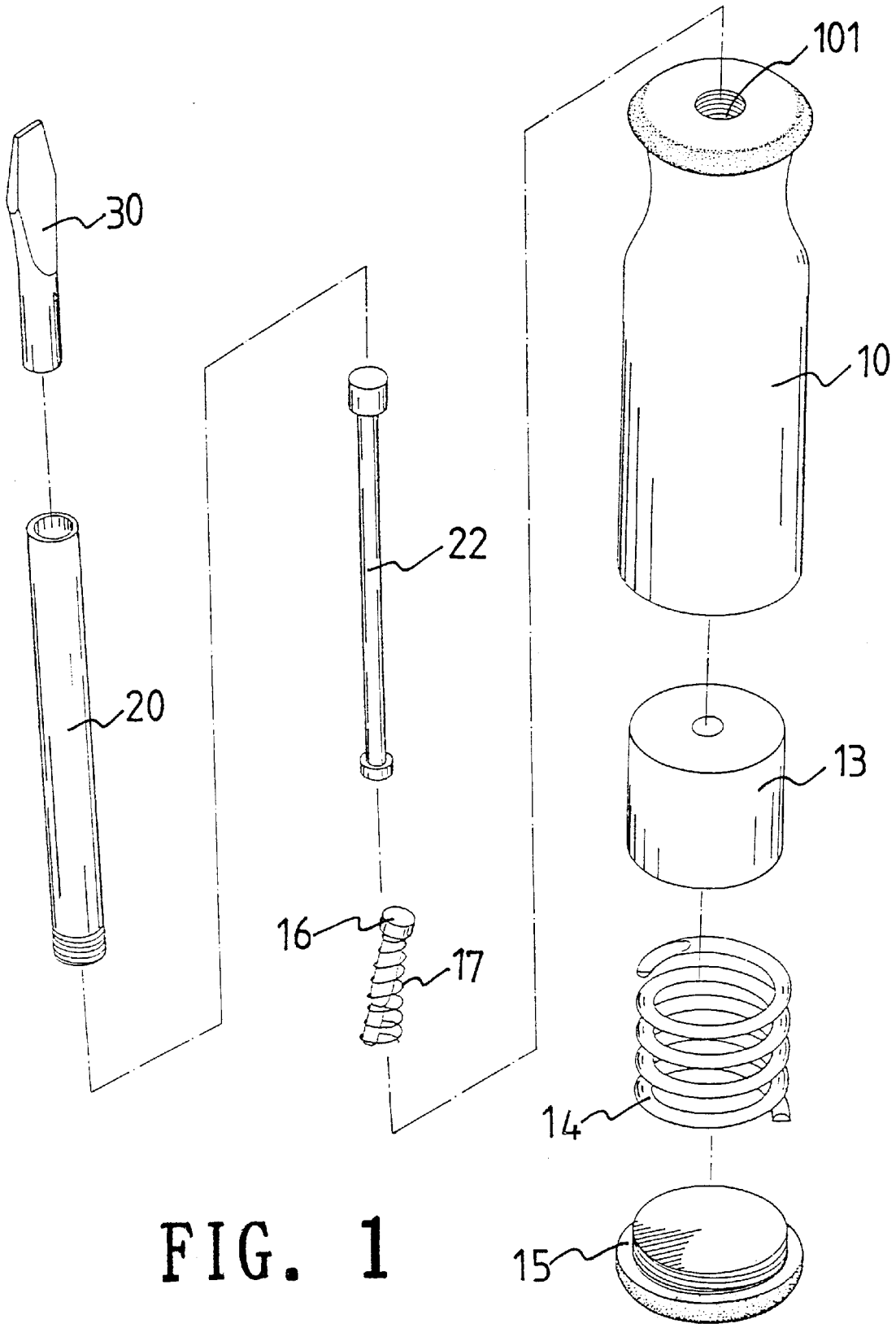
FIG. 1 is an exploded view to show the screwdriver and the impact device of the present invention.
Figure 2:
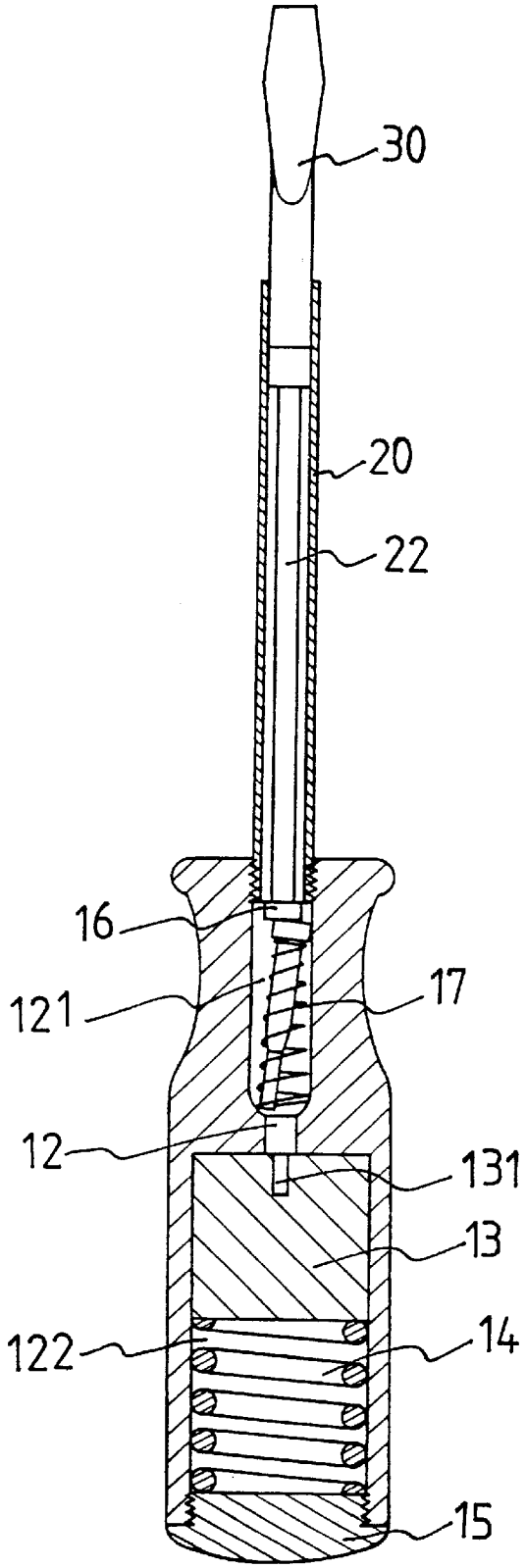
FIG. 2 is a cross-sectional view to show the screwdriver wherein the bit of the screwdriver is not yet pushed onto an object.
Figure 5:
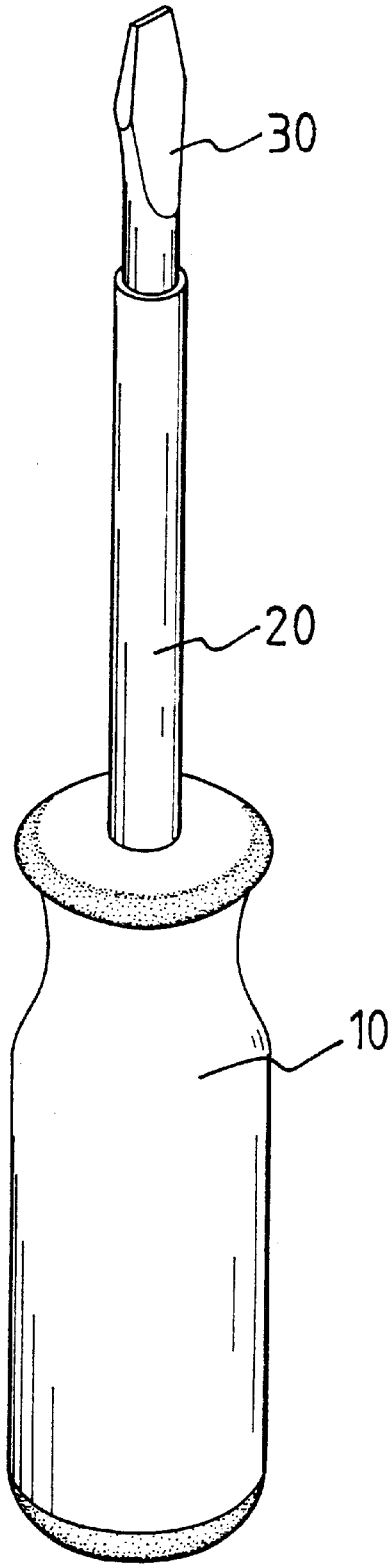
FIG. 5 is a perspective view to show the screwdriver of the present invention.

Referring to FIGS. 1, 2 and 5, the screwdriver in accordance with the present invention comprises a handle 10 having a chamber 122 defined in a first end thereof and a recess 121 defined in a second end of the handle 10. An annular flange extends radially inward from an inside of the handle 10 and is located between the recess 121 and the chamber 122. A passage 12 is defined through the annular flange and communicates with the recess 121 and the chamber.

A block 13 and a spring 14 are respectively received in the chamber 122. A cap 15 is threadedly connected to the first end of the handle 10 and seals the first end of the handle 10. Therefore, the block 13 is biased to contact the annular flange. The recess 121 in the handle 10 has a threaded inner periphery and a tube 20 is threadedly engaged with the threaded inner periphery. A shank 22 extends from the second end of the handle 10. An impact rod 16 is movably received in the recess 121 and a spring 17 is mounted to the impact rod 16. A first end of the impact rod 16 is sized to be inserted into the passage and a second end of the impact rod 16 contacts the shank 22. The block 13 has a dent 131 defined in an end thereof and the dent 131 communicates with the passage 12. The inner diameter of the dent 131 is smaller than the inner diameter of the passage 12. A bit 30 is removably connected to the tube 20 and contacts the shank 22.

Figure 3:
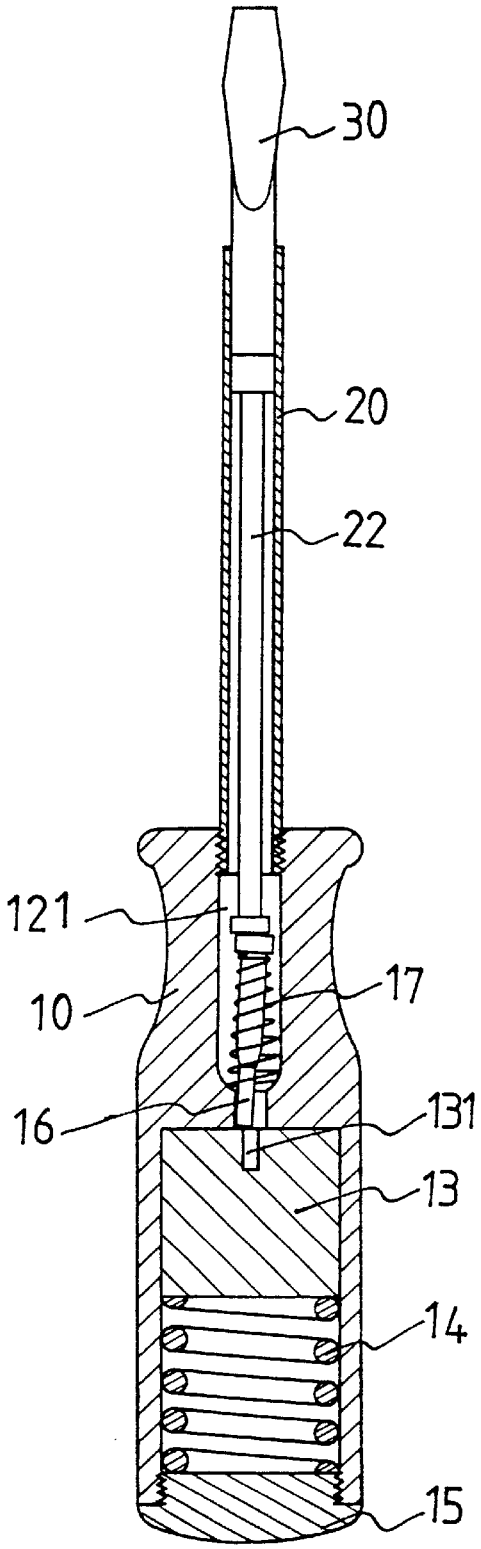
FIG. 3 is a cross-sectional view to show the screwdriver wherein the bit of the screwdriver is pushed onto an object.
Figure 4:
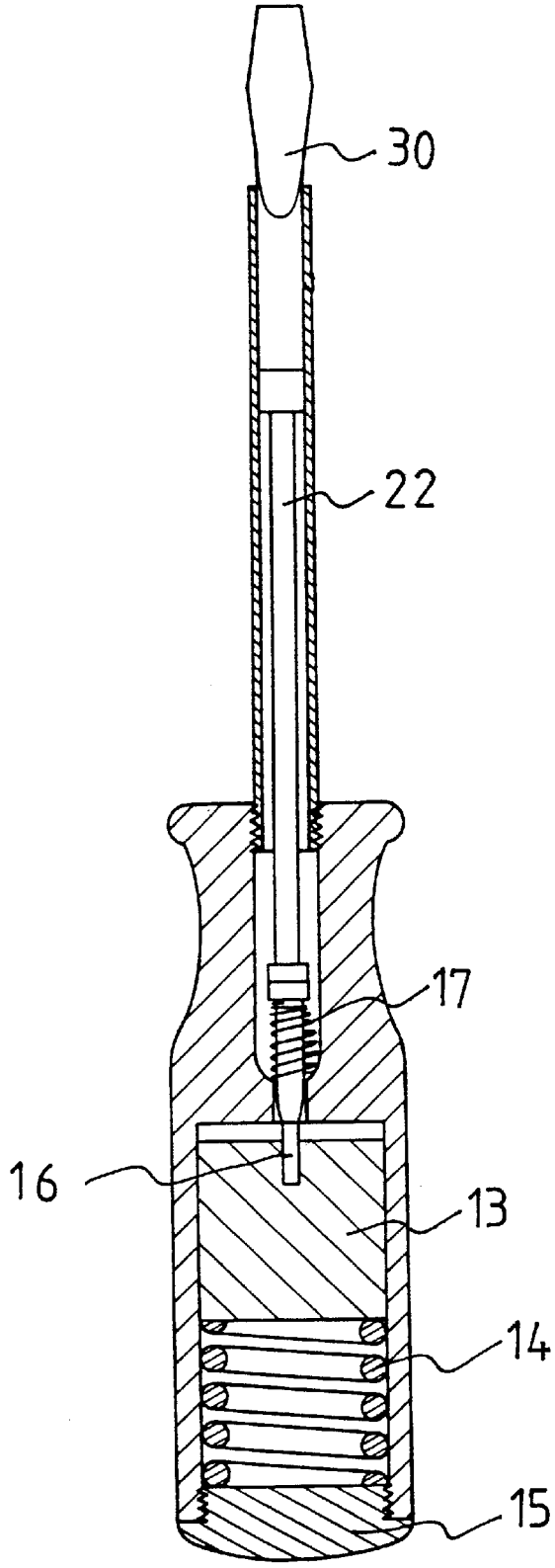
FIG. 4 is a cross-sectional view to show the screwdriver wherein an end of the impact rod extends through the passage and is engaged with the dent in the block.

As shown in FIGS. 3 and 4, when using the impact device, because the inner diameter of the dent 131 is smaller than the inner diameter of the passage 12, the user pushes the bit 30 of the screwdriver against an object so that the shank 22 is pushed by the movement of the bit 30 and an end of the impact rod 16 is inserted into the passage 12 to push the block 13 to compress the spring 14. When the user keeps on pushing the object, the end of the impact rod 16 is engaged with the dent 131 of the block 13. When the end of the impact rod 16 slips into the dent 131, the force of the spring 14 pushes the block 13 toward the impact rod 16 and exerts a sudden and huge force to the shank 22 and the bit 30. Therefore, the bit 30 hits the rusted object. By the screwdriver of the present invention, the user can handle the rusted object easily. The bit 30 is replaceable so that various types of bits can be employed to deal with different rusted objects.

Figure 6:
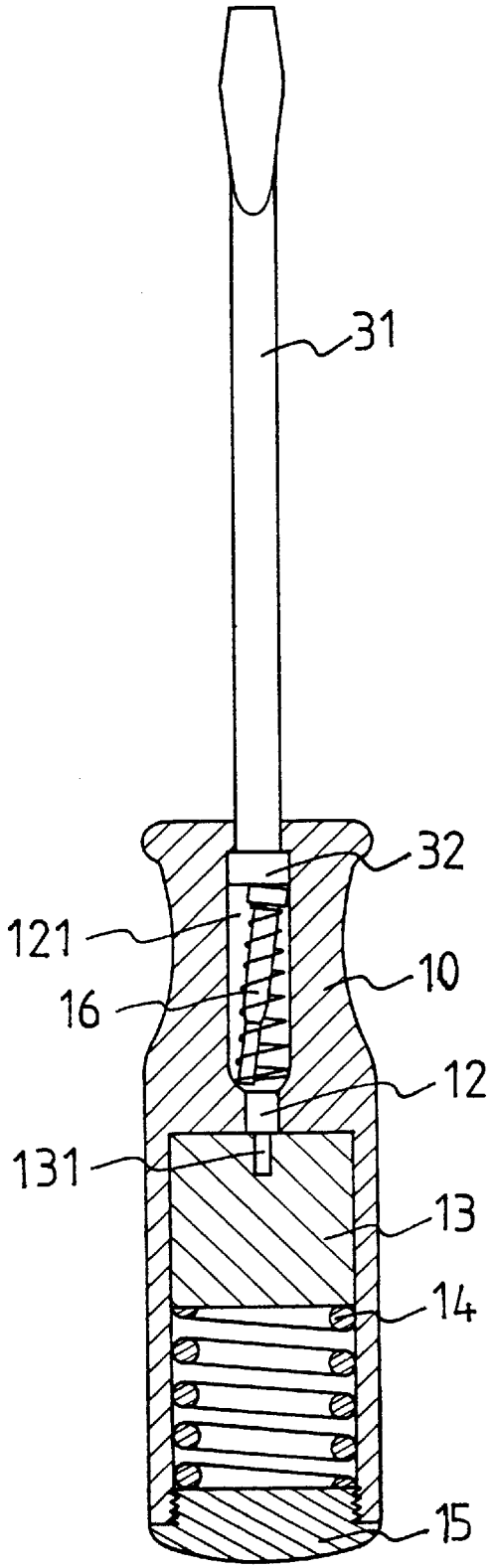
FIG. 6 is a cross-sectional view to show the other embodiment of the screwdriver of the present invention.

FIG. 6 shows that the screwdriver may be designed to have a shank 31 directly extend from the second end of the handle 10, and the impact rod 16 contacts the shank 31.

Wile we have shown and described various embodiments in accordance with the present invention, it should be clear to those skilled in the art that further embodiments may be made without departing from the scope and spirit of the present invention.

What is claimed is:

1. A screwdriver comprising:

a handle having a chamber defined in a first end thereof and a recess defined in a second end of said handle, a tube connected to said second end of said handle, a shank extending from said second end of said handle and movably received in said tube, a bit removably connected to said tube and contacting said shank an annular flange extending radially inward from an inside of said handle and located between said recess and said chamber, a passage defined through said annular flange and communicating with said recess and said chamber;

a block and a spring respectively received in said chamber, a cap connected to said first end of said handle and sealing said first end of said handle;

an impact rod movably received in said recess and a spring mounted to said impact rod, a first end of said impact rod sized to be inserted into said passage and a second end of said impact rod contacting said shank.

2. The screwdriver as claimed in claim 1, wherein said block has a dent defined in an end thereof and said dent communicates with said passage.

3. The screwdriver as claimed in claim 1, wherein said recess in said handle has a threaded inner periphery and said tube is threadedly engaged with said threaded inner periphery.

* * * * *